US005810632A

United States Patent [19]

Huston, III

[11] Patent Number: 5,810,632

[45] Date of Patent: Sep. 22, 1998

[54] FLOTATION MATTRESS ACCESSORY

[76] Inventor: William M. Huston, III, 35110 Rivals Rd., Wilmington, Ill. 60481

[21] Appl. No.: 808,801

[22] Filed: Feb. 28, 1997

[51] Int. Cl.[6] ..... B63C 9/08

[52] U.S. Cl. ..... 441/129

[58] Field of Search ..... 5/652, 701, 706; 441/40, 66, 125, 128, 129; 114/345

[56] References Cited

U.S. PATENT DOCUMENTS

| | | | |
|---|---|---|---|
| 1,927,124 | 9/1933 | Jones | 441/40 |
| 3,657,753 | 4/1972 | Blanc, Sr. | 441/66 |
| 4,021,873 | 5/1977 | Francois | 114/345 |
| 5,351,637 | 10/1994 | Brenckmann | 441/66 |
| 5,460,113 | 10/1995 | Gunter | 441/129 |

FOREIGN PATENT DOCUMENTS

| | | | |
|---|---|---|---|
| 2742989 | 4/1979 | Germany | 441/66 |

*Primary Examiner*—Sherman Basinger

[57] ABSTRACT

A new Flotation Mattress Accessory for restricting movement of a flotation mattress placed on a body of water. The inventive device includes a planar member adapted for overlying and being releasably attachable to a flotation mattress, and a tethering system coupled to the planar member for mooring the planar member and the flotation mattress to a stationary object thereby restricting movement of the planar member and the flotation mattress.

13 Claims, 3 Drawing Sheets

FLOTATION MATTRESS ACCESSORY

BACKGROUND OF THE INVENTION

1. Field of the Invention

The present invention relates to flotation devices and more particularly pertains to a new Flotation Mattress Accessory for restricting movement of a flotation mattress placed on a body of water.

2. Description of the Prior Art

The use of flotation devices is known in the prior art. More specifically, flotation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art flotation devices include U.S. Pat. No. 4,968,278; U.S. Pat. No. 5,421,757; U.S. Pat. No. D307,994; U.S. Pat. No. D304,652; U.S. Pat. No. 5,049,102; and U.S. Pat. No. 4,894,033.

While these devices fulfill their respective, particular objectives and requirements, the aforementioned patents do not disclose a new Flotation Mattress Accessory. The inventive device includes a planar member adapted for overlying and being releasably attachable to a flotation mattress, and a tethering means coupled to the planar member for mooring the planar member and the flotation mattress to a stationary object thereby restricting movement of the planar member and the flotation mattress.

In these respects, the Flotation Mattress Accessory according to the present invention substantially departs from the conventional concepts and designs of the prior art, and in so doing provides an apparatus primarily developed for the purpose of restricting movement of a flotation mattress placed on a body of water.

SUMMARY OF THE INVENTION

In view of the foregoing disadvantages inherent in the known types of flotation devices now present in the prior art, the present invention provides a new Flotation Mattress Accessory construction wherein the same can be utilized for restricting movement of a flotation mattress placed on a body of water.

The general purpose of the present invention, which will be described subsequently in greater detail, is to provide a new Flotation Mattress Accessory apparatus and method which has many of the advantages of the flotation devices mentioned heretofore and many novel features that result in a new Flotation Mattress Accessory which is not anticipated, rendered obvious, suggested, or even implied by any of the prior art flotation devices, either alone or in any combination thereof.

To attain this, the present invention generally comprises a planar member adapted for overlying and being releasably attachable to a flotation mattress, and a tethering means coupled to the planar member for mooring the planar member and the flotation mattress to a stationary object thereby restricting movement of the planar member and the flotation mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Flotation Mattress Accessory apparatus and method which has many of the advantages of the flotation devices mentioned heretofore and many novel features that result in a new Flotation Mattress Accessory which is not anticipated, rendered obvious, suggested, or even implied by any of the prior art flotation devices, either alone or in any combination thereof.

It is another object of the present invention to provide a new Flotation Mattress Accessory which may be easily and efficiently manufactured and marketed.

It is a further object of the present invention to provide a new Flotation Mattress Accessory which is of a durable and reliable construction.

An even further object of the present invention is to provide a new Flotation Mattress Accessory which is susceptible of a low cost of manufacture with regard to both materials and labor, and which accordingly is then susceptible of low prices of sale to the consuming public, thereby making such Flotation Mattress Accessory economically available to the buying public.

Still yet another object of the present invention is to provide a new Flotation Mattress Accessory which provides in the apparatuses and methods of the prior art some of the advantages thereof, while simultaneously overcoming some of the disadvantages normally associated therewith.

Still another object of the present invention is to provide a new Flotation Mattress Accessory for restricting movement of a flotation mattress placed on a body of water.

Yet another object of the present invention is to provide a new Flotation Mattress Accessory which includes a planar member adapted for overlying and being releasably attachable to a flotation mattress, and a tethering means coupled to the planar member for mooring the planar member and the flotation mattress to a stationary object thereby restricting movement of the planar member and the flotation mattress.

Still yet another object of the present invention is to provide a new Flotation Mattress Accessory that can be easily attached to a flotation mattress.

Even still another object of the present invention is to provide a new Flotation Mattress Accessory that would prevent a flotation mattress from floating under a diving board or shifting due to wind, thus making providing ideal conditions for relaxing in the water or sunbathing.

Even still another object of the present invention is to provide a new Flotation Mattress Accessory that would prevent a flotation mattress from disturbing swimmers and floating into others.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
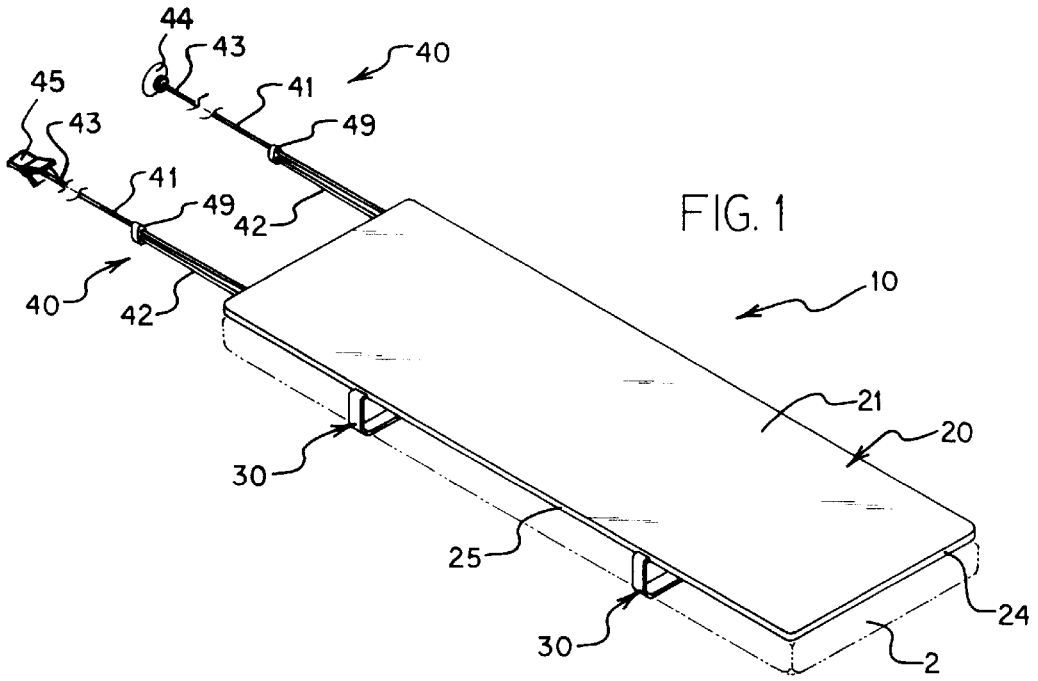
FIG. 1 is an illustration of a new Flotation Mattress Accessory secured to a flotation mattress according to the present invention.
Figure 2:
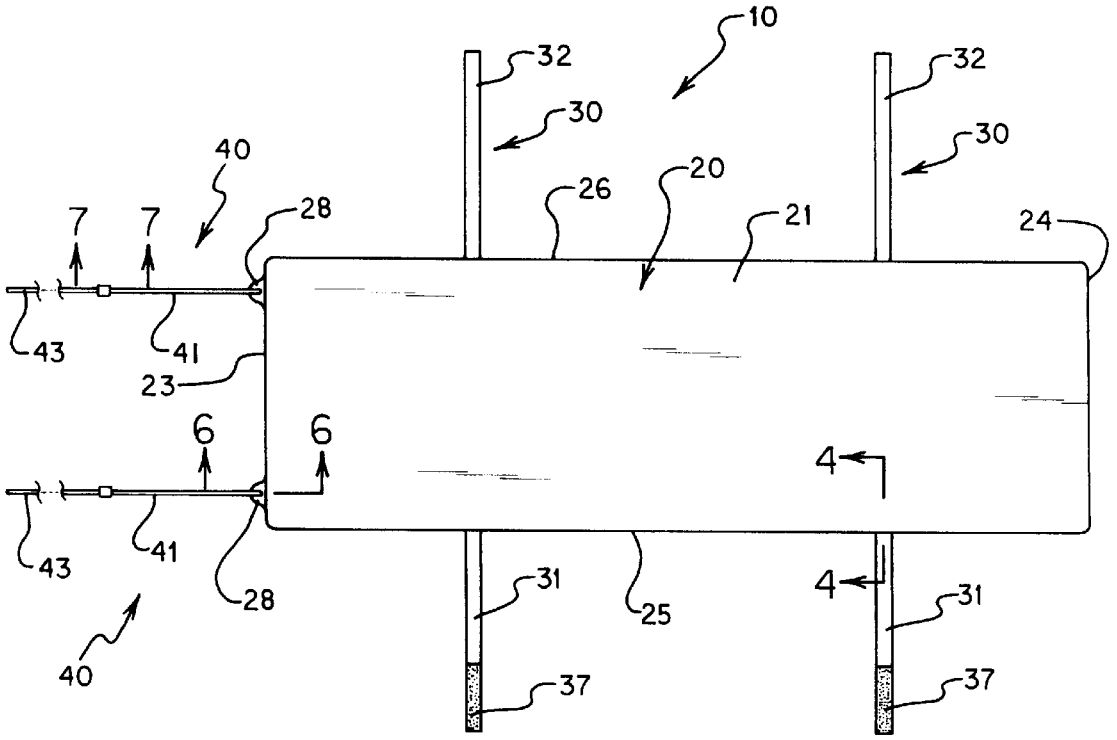
FIG. 2 is a top view of the present invention.
Figure 3:
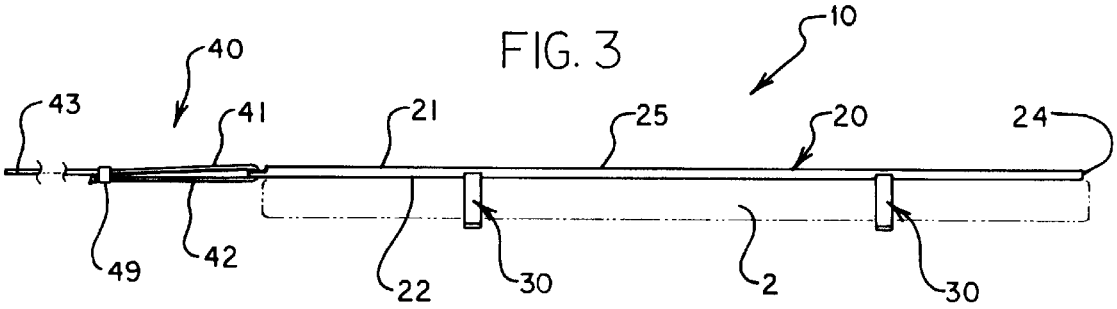
FIG. 3 is a side view of the present invention.
Figure 4:
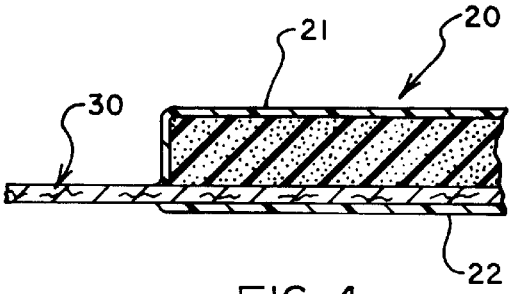
FIG. 4 is a cross sectional view taken along line 4—4 of FIG. 2.
Figure 5:
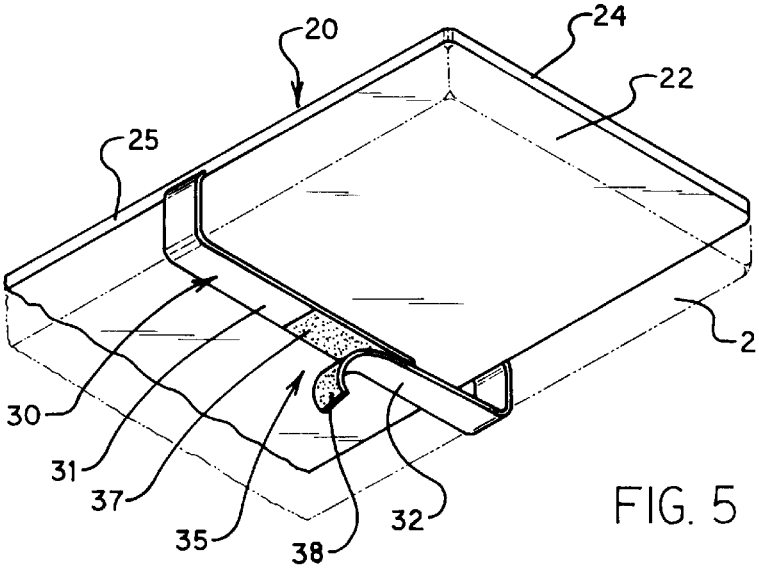
FIG. 5 is a bottom view of the present invention secured to a flotation mattress.
Figure 6:
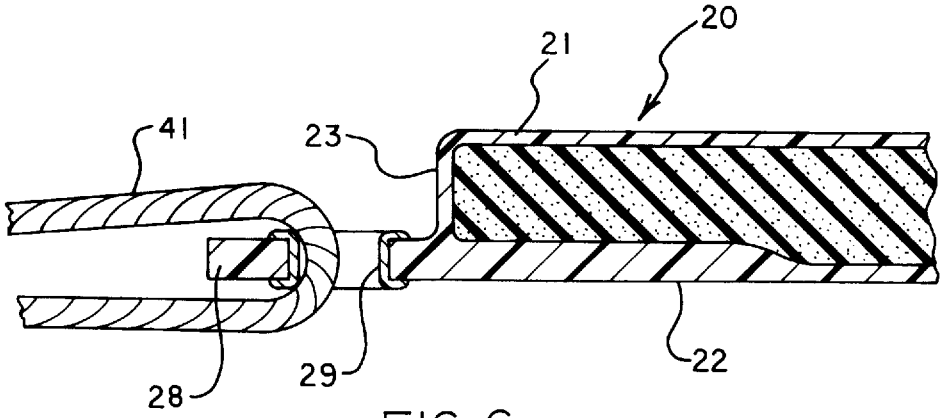
FIG. 6 is a cross sectional view taken along line 6—6 of FIG. 2.
Figure 8:
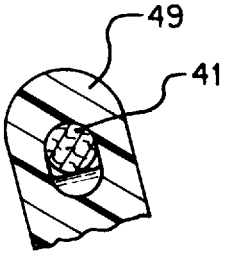
FIG. 8 is a cross sectional view taken along line 8—8 of FIG. 7.
Figure 7:
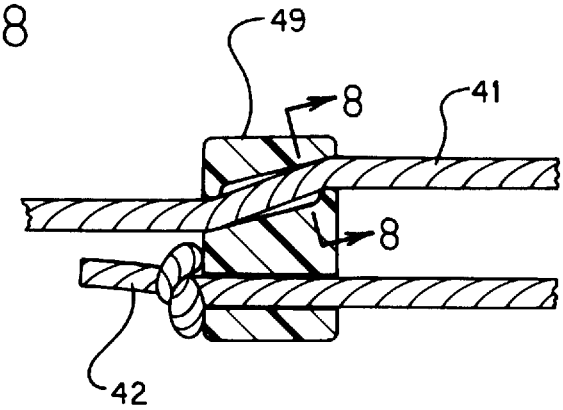
FIG. 7 is a cross sectional view taken along line 7—7 of FIG. 2.

With reference now to the drawings, and in particular to FIGS. 1 through 8 thereof, a new Flotation Mattress Accessory embodying the principles and concepts of the present invention and generally designated by the reference numeral 10 will be described.

More specifically, it will be noted that the Flotation Mattress Accessory 10 comprises a planar member 20 adapted for overlying and being releasably attachable to a flotation mattress 2, and a tethering means 40 coupled to the planar member 20 for mooring the planar member 20 and the flotation mattress 2 to a stationary object thereby restricting movement of the planar member 20 and the flotation mattress 2.

As best illustrated in FIGS. 1 through 5, it can be shown that the planar member 20 is generally rectangular in shape and has a top surface 21, a bottom surface 22, a top edge 23, a bottom edge 24, a first side edge 25, and a second side edge 26. The planar member 20 is adapted for overlying a flotation mattress 2 wherein the bottom surface 22 of the planar member 20 abuts a topside of the flotation mattress 2. The planar member 20 is generally flexible and conformable in use to the flotation mattress 2.

A securing strap 30 is provided for releasably attaching the planar member 20 to the flotation mattress 2. The securing strap 30 is attached to the bottom surface 22 of the planar member 20 and has a first end 31 extending beyond the first side edge 25 and a second end 32 extending beyond the second side edge 26 wherein the first end 31 and the second end 32 are oppositely wrapped around the flotation mattress 2 and releasably fastened on an underside thereof. A releasable fastener 35 is provided for releasably fastening the first end 31 and the second end 32 of the securing strap 30. The releasable fastener 35 comprises a hook and loop fastener 36 including a hook portion 37 provided on the first end 31 of the securing strap 30 and a mating loop portion 38 provided on the second end 32 of the securing strap 30.

As best illustrated in FIGS. 1 through 8, it can be shown that the tethering means 40 comprises a tethering line 41 having a first end 42 coupled to the top edge 23 of the planar member 20 and a second end 43 attachable to a stationary object. To couple the tethering line 41 to the planar member 20, the tethering line 41 may be inserted through a hole 29 provided in a tab 28 protruding from the top edge 23 of the planar member 20. The tethering line 41 is adjustable such that the planar member 20 and the flotation mattress 2 may be moored in a predetermined location. A sliding coupler 49 may be used for coupling the first end 42 of the tethering line 41 to the top edge 23 of the planar member 20 and for adjusting the length of the tethering line 41. An attachment means may be provided at the second end 43 of the tethering line 41 for attaching the tethering line 41 to a stationary object. The attachment means may comprise a clip 45 for attachment of the second end 43 of the tethering line 41 to the side of pool or may comprise a suction cup 44 for attachment of the second end 43 of the tethering line 41 to a pool wall.

In use, the planar member 20 is laid over the flotation mattress 2 wherein the bottom surface 22 of the planar member 20 abuts a topside of the flotation mattress 2. Thereafter, the first end 31 of the securing strap 30 and the second end 32 of the securing strap 30 are wrapped around opposite sides of the flotation mattress 2 and are releasably fastened on an underside of the flotation mattress 2 by the hook and loop fastener 36. The second end 43 of the tethering line 41 is attached to a stationary object and the tethering line 41 is adjusted such that the planar member 20 and the flotation mattress 2 are moored in a predetermined location when placed on a body of water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flotation mattress accessory for use with a flotation mattress, comprising:

a planar member adapted for overlying and being releasably attachable to said flotation mattress;

a tethering means coupled to said planar member for mooring said planar member and said flotation mattress to a stationary object thereby restricting movement of said planar member and said flotation mattress;

said planar member has a first side edge and a second side edge, and further comprising:

a securing strap attached to said planar member;

said securing strap having a first end extending beyond said first side edge of said planar member and having a second end extending beyond said second side edge of said planar member; and said securing strap releasably attaching said planar member to said flotation mattress wherein said first end of said securing strap and said second end of said securing strap are oppositely wrapped around said flotation mattress and releasably fastened on an underside thereof.

2. The flotation mattress accessory of claim 1, further comprising:

a releasable fastener provided on said first end of said securing strap and said second end of said securing strap; and said releasable fastener releasably fastening said first end of said securing strap and said second end of said securing strap.

3. The flotation mattress accessory of claim 2, wherein said releasable fastener comprises:

a hook and loop fastener including a hook portion provided on said first end of said securing strap and a mating loop portion provided on said second end of said securing strap.

4. The flotation mattress accessory of claim 1, wherein said planar member has a top edge, and wherein said tethering means comprises:

an adjustable tethering line having a first end coupled to said top edge of said planar member and having a second end attachable to a stationary object.

5. The flotation mattress accessory of claim 4, further comprising:

an attachment means provided at said second end of said tethering line for attaching said tethering line to said stationary object.

6. The flotation mattress accessory of claim 5, wherein said attachment means comprises:

at least one of a clip for attachment of said second end of said tethering line to a side of a pool; and a suction cup for attachment of said second end of said tethering line to a pool wall.

7. The flotation mattress accessory of claim 1, wherein said planar member is generally flexible and conformable in use to said flotation mattress.

8. A flotation mattress accessory for use with a flotation mattress, comprising:

a planar member having a bottom surface, a top edge, a first side edge, and a second side edge;

said planar member adapted for overlying said flotation mattress wherein said bottom surface of said planar member abuts a topside of said flotation mattress;

a securing strap attached to said planar member;

said securing strap having a first end extending beyond said first side edge of said planar member and having a second end extending beyond said second side edge of said planar member;

said first end of said securing strap releasably fastenable to said second end of said securing strap;

said securing strap releasably attaching said planar member to said flotation mattress wherein said first end of said securing strap and said second end of said securing strap are oppositely wrapped around said flotation mattress and releasably fastened on an underside thereof; and an adjustable tethering line having a first end coupled to said top edge of said planar member and having a second end attachable to a stationary object.

9. The flotation mattress accessory of claim 8, wherein said planar member is generally flexible and conformable in use to said flotation mattress.

10. The flotation mattress accessory of claim 8, further comprising:

a releasable fastener provided at said first end of said securing strap and at said second end of said securing strap, said releasable fastener releasably fastening said first end of said securing strap and said second end of said securing strap.

11. The flotation mattress accessory of claim 10, wherein said releasable fastener comprises:

a hook and loop fastener including a hook portion provided on said first end of said securing strap and a mating loop portion provided on said second end of said securing strap.

12. The flotation mattress accessory of claim 8, further comprising:

an attachment means provided at said second end of said tethering line for attaching said tethering line to said stationary object.

13. The flotation mattress accessory of claim 12, wherein said attachment means comprises at least one of a clip for attachment of said second end of said tethering line to a side of a pool and a suction cup for attachment of said second end of said tethering line to a pool wall.

* * * * *